US005841114A

United States Patent [19]

Jeong

[11] Patent Number: 5,841,114

[45] Date of Patent: Nov. 24, 1998

[54] MICROWAVE OVEN EQUIPPED WITH A MICROWAVE OUTPUT CONTROLLING APPARATUS

[75] Inventor: Shin-Jae Jeong, Incheon, Rep. of Korea

[73] Assignee: Daewoo Electronics Co., Ltd., Rep. of Korea

[21] Appl. No.: 104,705

[22] Filed: Jun. 25, 1998

[30] Foreign Application Priority Data

Aug. 30, 1997 [KR] Rep. of Korea ..... 97-44079
Aug. 30, 1997 [KR] Rep. of Korea ..... 97-44080

[51] Int. Cl.[6] ..... H05B 6/64; H01J 25/02

[52] U.S. Cl. ..... 219/761; 315/5.11; 315/5.37; 315/39.63; 313/299; 331/184

[58] Field of Search ..... 219/761, 715; 315/5.11, 5.12, 5.13, 5.37, 5.44, 12.1, 39.51, 39.57, 39.63, 39.77, 101, 200 R, 206, 208; 331/184, 89, 91; 313/296, 299

[56] References Cited

U.S. PATENT DOCUMENTS 2,529,668 11/1950 Wang ..... 315/5.12
3,805,111 4/1974 Ryabinin et al. ..... 315/39.51
5,233,269 8/1993 Lien ..... 315/5.37
5,541,391 7/1996 Seong ..... 219/761

*Primary Examiner*—Philip H. Leung
*Attorney, Agent, or Firm*—Pennie & Edmonds LLP

[57] ABSTRACT

A microwave oven includes a microwave generating apparatus having a cathode, a first grid for controlling the flow of electrons from the cathode, the first grid having holes for converting electrons from the cathode to the electron beams, a choke structure, positioned between the cathode and the first grid, for serving as a blocking capacitor, wherein the cathode, the first grid and the choke structure define an input cavity functioning as a resonant circuit, an array of resistors, one end of which is connected to the first grid and the other end thereof is connected to the cathode, for inducing a bias voltage on the first grid, a controller for controlling the array of resistors to make a plurality of resistance values, a second grid provided above the first grid and having holes through which the electron beams passing through holes of the first grid pass, an anode for receiving the electrons passing through the holes of the second grid, wherein the second grid and the anode define an output cavity for generating a microwave, the output cavity being electrically insulated from the input cavity, and a driving voltage source for providing a driving voltage to the cathode and the anode.

8 Claims, 8 Drawing Sheets

MICROWAVE OVEN EQUIPPED WITH A MICROWAVE OUTPUT CONTROLLING APPARATUS

FIELD OF THE INVENTION

The present invention relates to a microwave oven; and, more particularly, to a microwave oven equipped with an apparatus for optimally controlling the output thereof.

BACKGROUND OF THE INVENTION

There is shown in FIG. 1 a microwave oven including a housing 1, a power supply unit 2 having a high voltage transformer (not shown) and a high voltage condenser (not shown), a cylindrical magnetron 10 for generating a microwave and a cooking chamber 3 for containing food therein. As shown in FIG. 2, the magnetron 10 is a cylindrical bi-pole vacuum tube and typically includes a cathode 11 arranged at the center thereof, a pair of magnets 12*a,* 12*b* disposed thereabove and therebeneath respectively, an anode 13 arranged around the cathode 11 and an antenna 14 connected to the anode 13.

When an operating voltage of, e.g., 4KV, is applied to an input terminal 15 from the power supply unit 2, the cathode 11 is heated to emit electrons. The emitted electrons are received by the anode 13.

The magnets 12*a,* 12*b* generate magnetic fluxes which are, in turn, guided by guide members 16*a,* 16*b* to pass through a cavity 17 which is defined between the cathode 11 and the anode 13. The electrons emitted from the cathode 11 are first deviated by a magnetic field formed in the cavity 17 so that they revolve between the cathode 11 and the anode 13 prior to traveling to the anode 13 and being received thereat.

Revolving of the electrons between the cathode 11 and the anode 13 results in a resonant circuit being constructed in the anode 13, the resonant circuit generating microwaves to be emitted through the antenna 14. The emitted microwaves are guided to the cooking chamber 3 by a waveguide 5 and then spread in the cooking chamber 3 by a stirrer 6. The spread microwaves are incident on food contained in the cooking chamber 3 so that cooking of the food can be carried out.

In such a microwave oven, since the motion of electrons is controlled by the combined force of both electric and magnetic fields, a plurality of magnets are required, which, in turn, makes the microwave oven structurally complicated. Further, the microwave generating apparatus employed in the conventional microwave oven is incapable of generating and outputting microwaves which are stable and continuous and have a proper amplitude for the food being cooked.

SUMMARY OF THE INVENTION

It is, therefore, a primary object of the invention to provide a microwave oven equipped with an microwave output controlling apparatus for providing microwaves which are stable and continuous and have a proper amplitude for the food being cooked therein.

In accordance with the present invention, there is provided a microwave oven incorporating therein a cooking chamber, a waveguide, and an apparatus for generating a microwave, said apparatus being further characterized in that said apparatus comprises: a heating element; a cathode, mounted above the heating element, for emitting electrons; a first grid, provided above the cathode, for controlling and focusing the flow of electrons emitted from the cathode, the first grid having a plurality of holes for converting electrons from the cathode to the electron beams; a choke structure for serving as a blocking capacitor, the choke structure being positioned between the cathode and the first grid, wherein the cathode, the first grid and the choke structure define an input cavity functioning as a resonant circuit; an array of resistors, one end of which is connected to the first grid and the other end thereof is connected to the cathode, for inducing a bias voltage on the first grid; a controller for controlling the array of resistors to thereby generate a plurality of resistance values; a second grid provided above the first grid and having a plurality of holes through which the electron beams passing through the holes of the first grid pass; an anode for receiving the electrons passing through the holes of the second grid, wherein the second grid and the anode define an output cavity for generating a microwave, the output cavity being electrically insulated from the input cavity; cooling fins, provided around the anode, for cooling heat generated by the anode; a driving voltage source for providing a driving voltage to the cathode and the anode; an antenna arranged in the anode, for extracting the microwave from the output cavity into the cooling chamber through the waveguide; and a feedback structure extending from the input cavity to the output cavity, for feeding a portion of the microwave in the output cavity back to the input cavity.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
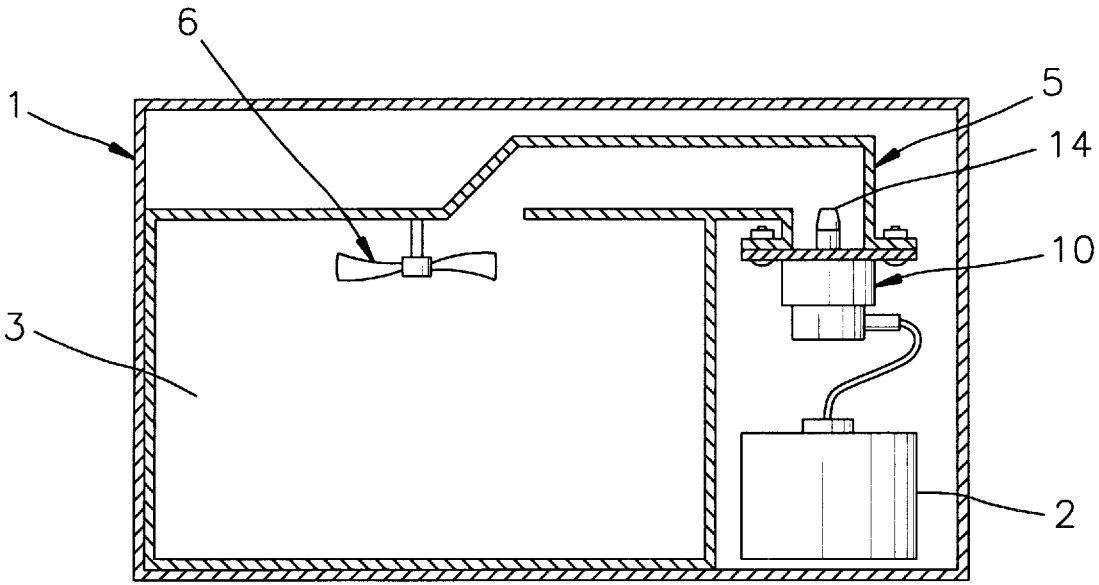
FIG. 1 (PRIOR ART)
FIG. 1 shows a schematic view of a conventional microwave oven.
Figure 2:
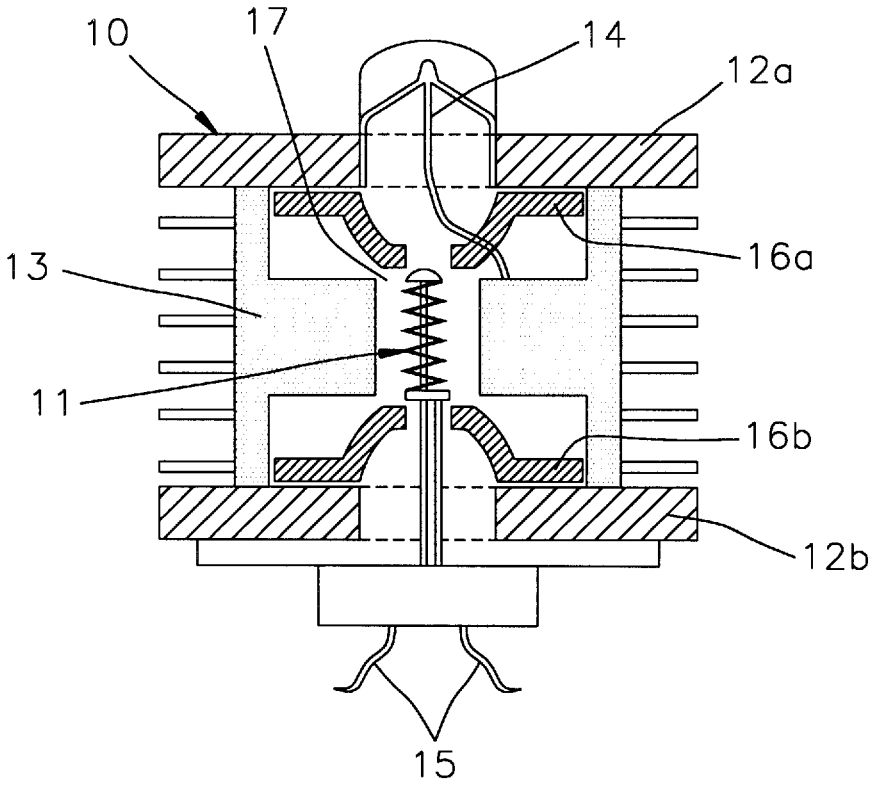
FIG. 2 (PRIOR ART)
FIG. 2 describes a sectional view of a magnetron of the microwave oven in FIG. 1.
Figure 3:
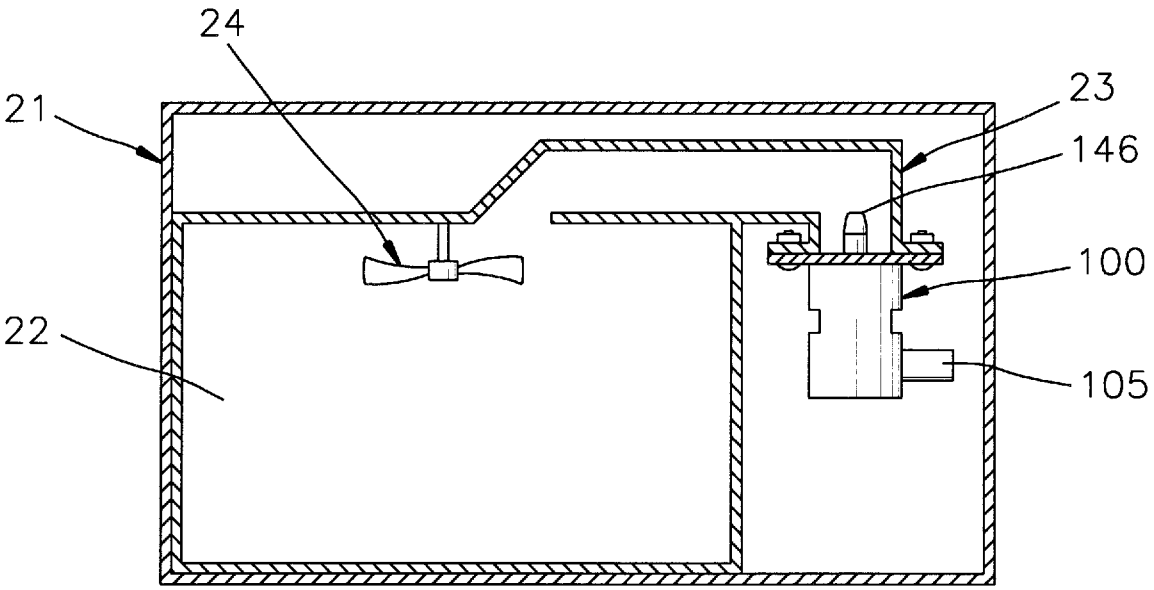
FIG. 3 presents a schematic view of a microwave oven in accordance with the present invention.

Referring to FIG. 3, a microwave oven in accordance with the present invention includes a housing 21, an apparatus 100 for generating a microwave, a power supply unit 105 mounted at the apparatus 100, and a cooking chamber 22 for containing food therein. The microwave generating apparatus 100 includes a filter box 101 whose bottom is covered by a plate 102 and whose top is covered by a bracket 103 (see FIG. 4).

Figure 4:
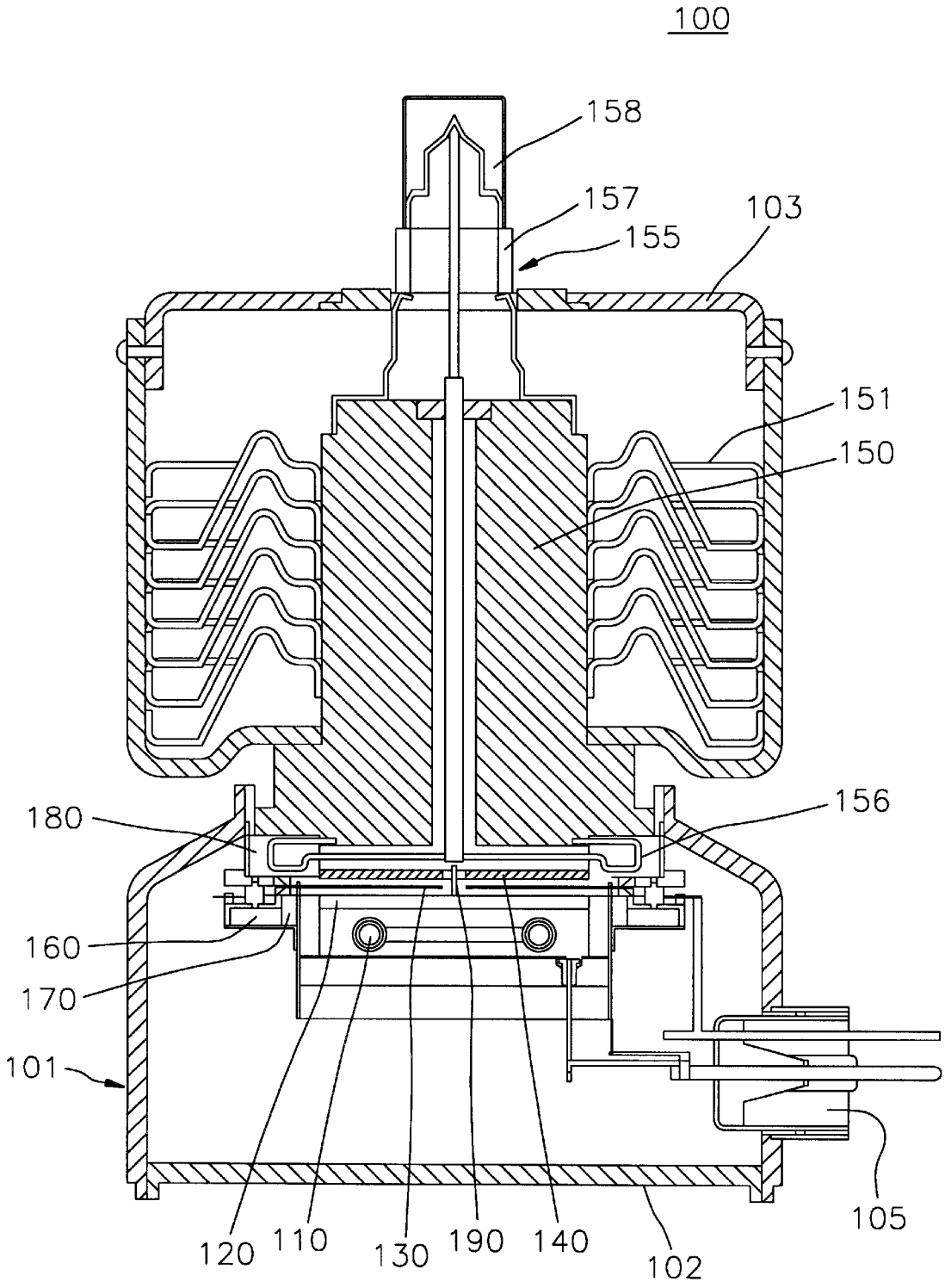
FIG. 4 represents a sectional view setting forth a structure of the microwave generating apparatus in accordance with the present invention.
Figure 5:
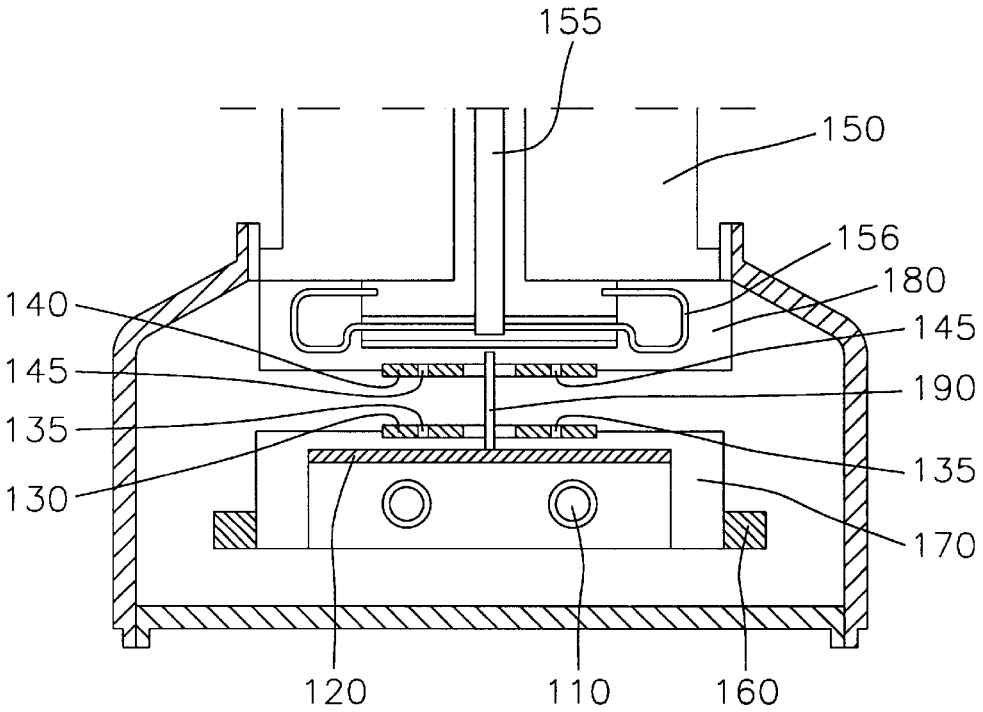
FIG. 5 offers a partial sectional view setting forth a structure of the microwave generating apparatus in FIG. 4.

Referring to FIGS. 4 and 5, the filter box 101 is provided with a heater 110, as a heating element, electrically connected to the power supply unit 105, a cathode 120, a first grid 130, a second grid 140 and an anode 150. Further, a vacuum is maintained inside the filter box 101.

Figure 6:
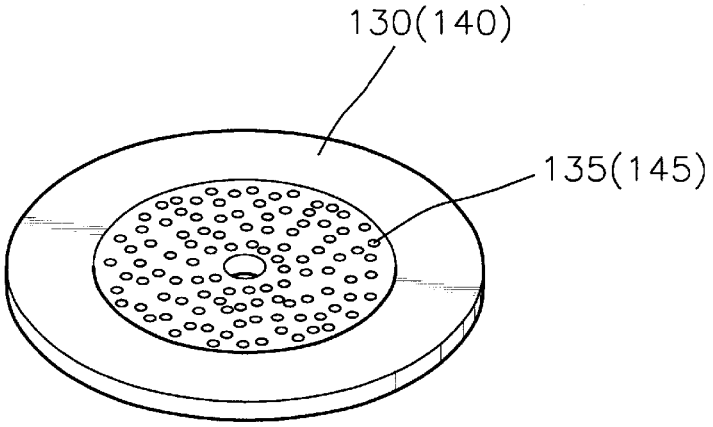
FIG. 6 depicts a perspective view of grids incorporated in the microwave generating apparatus in accordance with the present invention.

The heater 110 is composed of a filament and the cathode 120 is positioned above the heater 110. The cathode 120 having a disc shape emits thermal electrons when the heater 110 is heated. The first grid 130 for controlling and focusing the electrons emitted from the cathode 120 is disposed above the cathode 120. The first grid 130 has a disc shape formed with a plurality of holes 135 (see FIG. 6). Between the cathode 120 and the first grid 130, a choke structure 160 is provided. The first grid 130, the choke structure 160 and the cathode 120 define an input cavity 170, functioning as a resonant circuit.

Mounted above the first grid 130 is the second grid 140 having a plurality of holes 145 through which electron beams via the holes 135 of the first grid 130 pass. Mounted above the second grid 140 is the anode 150 having a cylindrical shape and provided with cooling fins 151 therearound so as to cool the heat generated by the anode 150. The second grid 140 and the anode 150 define an output cavity 180 for generating a microwave. The output cavity 180 is electrically insulated from the input cavity 170. In particular, the second grid 140 is distanced apart from the first grid 130 in such a way that the electron beams passing through the holes 135 of the first grid 130 generate a microwave in the output cavity 170 effectively before they become diffused.

A kinetic energy of the electrons modulated in its density in the input cavity 170 is converted to the microwave in the output cavity 180 and then the microwave is radiated to the cooking chamber 22 through an antenna 155 arranged in the anode 150 and a waveguide 23. The antenna 155 has a loop-shaped coupling 156 disposed in the output cavity 180, for extracting the microwaves therein, an insulated member 157 made of an insulator for insulating the antenna 155 from the filter box 101, and a cap 158.

Between the input cavity 170 and the output cavity 180, there extends a feedback structure 190 which feeds a part of the microwave in the output cavity 180 back to the input cavity 170 so as to also induce a resonant circuit. The feedback structure 190 has a rod shape.

Figure 7:
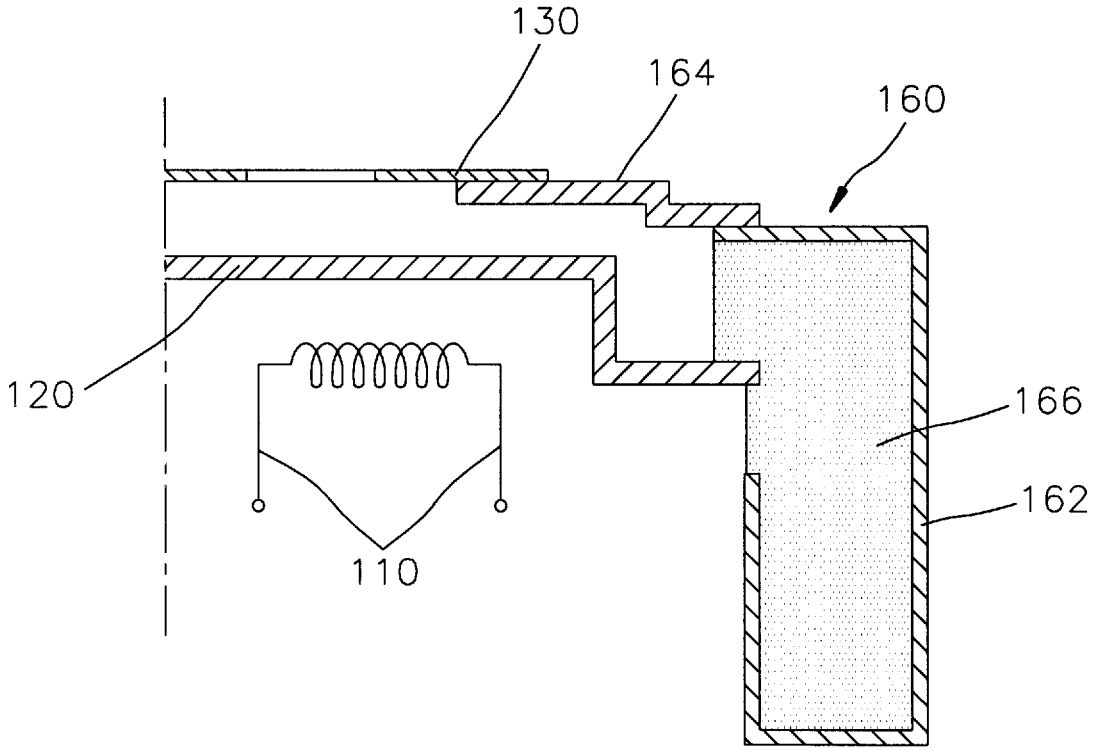
FIG. 7 illustrates a sectional view of a choke structure incorporated in the microwave generating apparatus in accordance with the present invention.

Referring to FIG. 7, the choke structure 160 includes a metallic plate 162 supported by a grid holder 164 between the first grid 130 and the cathode 120 and a dielectric material 166 in the input cavity 170. The metallic plate 162 is electrically insulated from the cathode 120. The choke structure 160 serves as a blocking capacitor for passing a surface current for generating the microwave in the input cavity 170 therethrough and blocking a direct current.

Figure 8:
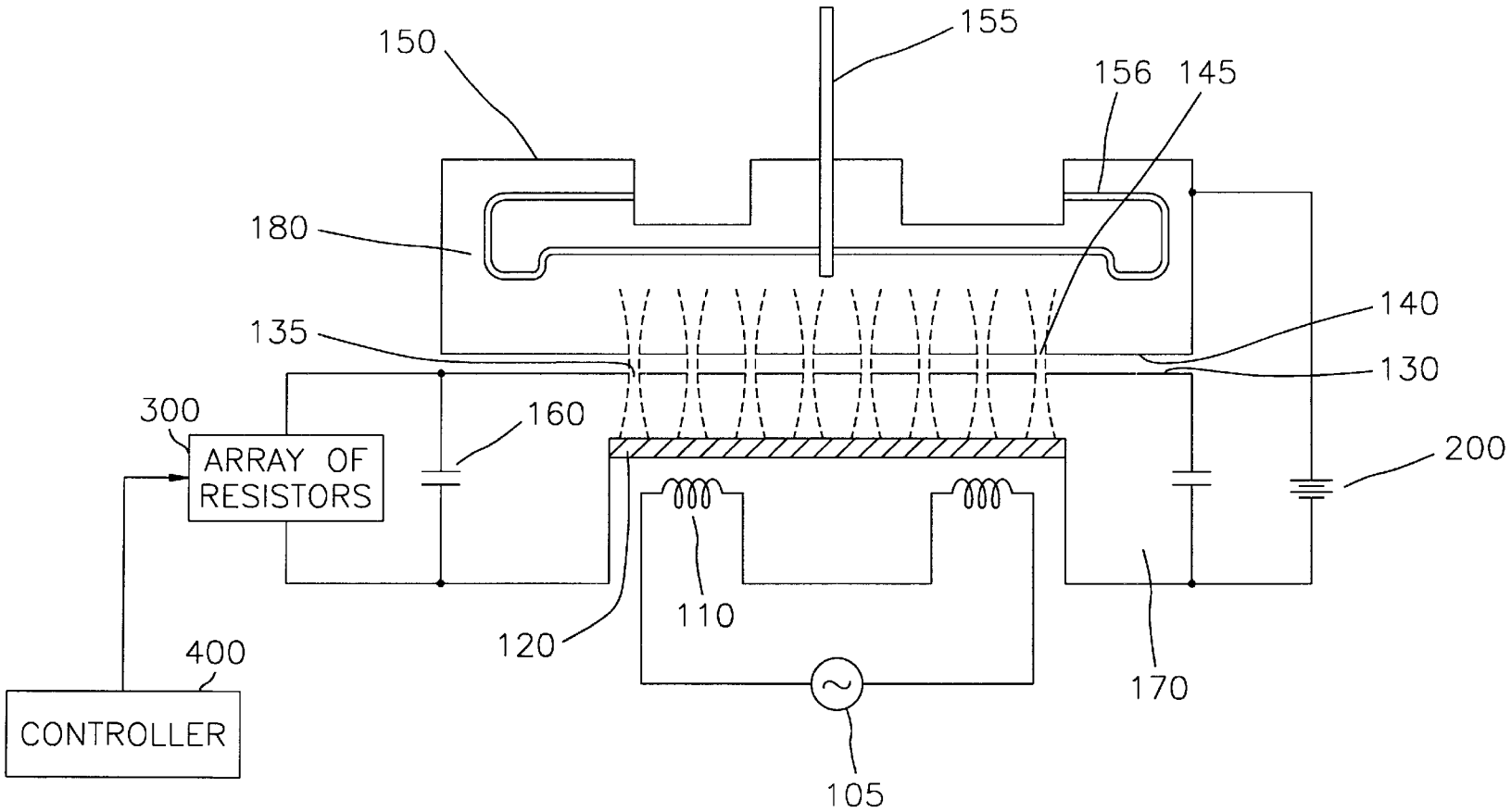
FIG. 8 discloses an equivalent circuit of the microwave generating apparatus in FIG. 4.

There is shown in FIG. 8 an equivalent circuit of the microwave generating apparatus 100 in FIG. 5.

The heater 110 is electrically connected with the power supply unit 105. The anode 150 and the cathode 120 are, respectively, connected with a positive terminal and a negative terminal of a driving DC source 200 for providing voltage range between 300V to 500V.

The second grid 140 has an identical potential as that of the anode 150 since the second grid 140 is integral with the anode 150. However, the first grid 130 is integral with the cathode 120 but the first grid 130 has a different potential from the cathode 120 due to the choke structure 160.

An array of resistors 300 is further provided, one end of the array of resistors 300 being connected to the first grid 130 and the other end thereof being to the cathode 120. The array of resistors 300 has an associated resistance value.

Further, a controller 400 for controlling the array of resistors 300 to generate different combinations of resistance values, each of the combinations depending on the kind of food is provided in the microwave oven.

The first grid 130 has a zero bias voltage when the microwave generating apparatus 100 is initially operated. The array of resistors 300 in conjunction with the controller 400 serves to induce an appropriate bias voltage, e.g., −60V, on the first grid 130.

Figure 9:
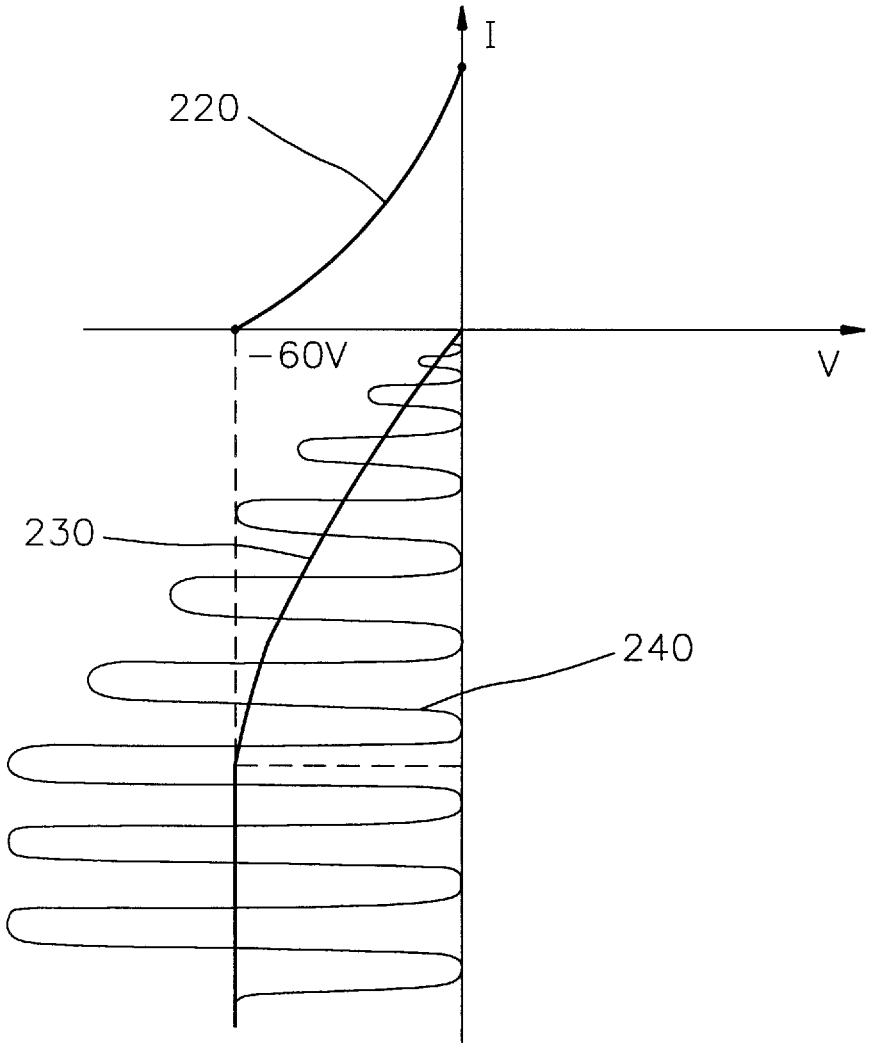
FIG. 9 provides a voltage characteristic graph of the first grid incorporated in the microwave generating apparatus in accordance with the present invention.

In FIG. 9, a first curve 220 shows the amount of current change flowing on the anode 150, a second curve 230 depicts the bias voltage change applied into the first grid 130, and a third curve 240 illustrates a resonant waveform of the microwave in the input cavity 170.

With reference to FIGS. 8, 9, the operating principle of the inventive apparatus 100 will be now described in detail.

When the heater 110 is heated to a temperature between 600° C. to 1200° C., the cathode 120 emits electrons. Since the first grid 130 has a zero bias voltage initially, a portion of the electrons emitted from the cathode 120 reaches the anode 150 via the holes 135, 145 of the first grid 130 and the second grid 140, and the remaining electrons get absorbed onto the first grid 130. The electrons absorbed onto the first grid 130 induce a bias voltage and a surface current flows on a surface of the input cavity 170, its flowing direction being changed by the choke structure 160, which, in turn, induces a weak oscillation in the input cavity 170. As a result of the surface current flow when enough current is accumulated on the first grid 130, an amplitude of the above mentioned oscillation increases, as will be described later.

The absorption of the electrons emitted from the cathode 120 into the first grid 130 causes the first grid 130 to have a negative potential. Initially, the negative potential on the first grid 130 sharply increases since, as a result of the first grid 130 having initially a zero bias voltage, a relatively large amount of the electrons are able to get absorbed thereonto, the amount of electrons getting absorbed onto the first grid 130 decreasing with time. The negative potential on the first grid 130 gradually increases until it reaches a predetermined value, the value being determined by the amount of electrons that can be absorbed onto the first grid 130 which is in turn, determined by the combination of resistance values of the array of resistors 300 and the controller 400. The controller 400 generates an appropriate resistance values.

The array resistors 300 can be replaced with a trimming resistor(not shown), trimming resistor in conjunction with a controller 400 will serve the similar functions as the above.

In response to the potential change, the amplitude of the oscillation increases with time until the potential on the first grid 130 reaches the predetermined value, at which the amplitude of the oscillation becomes constant. At this point, the first grid 130 has a predetermined voltage and the oscillation oscillates at a resonant frequency determined by a resonant structure of the input cavity 170.

At the same time, in response to the potential change of the first grid 130, the electrons emitted from the cathode 120 are continuously modulated in its density and grouped in the input cavity 170, until the potential on the first grid 130 reach a predetermined bias potential.

However, as the potential difference between the first grid 130 and the second grid 140 increases, an electric field therebetween also increases. When the electron groups in the input cavity 170 pass through the holes 135 of the first grid 130 as shown by broken lines in FIG. 8 as a result of the electric field formed between the input cavity 170 and the output cavity 180, they are converted to electron beams, the electron beams accelerating between the first grid 130 and the second grid 140. The accelerated electron beams move toward the anode 150 through the holes 145 of the second grid 140. The kinetic energy of the electrons is converted to the microwave energy, emitting the microwave. The microwave is output by the antenna 155 and guided into the cooking chamber 22 by a waveguide 23. The microwave is then spread by a stirrer 24 and is incident on food contained in the cooking chamber 22, so that cooking can be carried out.

In such an apparatus, since the first and the second grids, in conjunction with each other, focus and control the electrons beams, a plurality of magnets can be eliminated, and since the first grid, the cathode, the choke structure and the second grid, the anode define the input cavity and the output cavity, respectively, the microwave oven has a simple structure. In addition, since the metallic plate filled with the dielectric material shortens a wave length of the microwave to be generated in the input cavity, it is possible to reduce the size of the microwave generating apparatus. Further, since the first grid is distanced apart from the second grid, it is possible to reduce influence of a harmonic and a noise between the grids, and it is possible to provide the microwaves which are stable and continuous and have a proper amplitude for the food being cooked therein by allowing the array of resistors to control the bias potential of the first grid by the controller.

Although the invention has been shown and described with respect to the preferred embodiments, it will be understood by those skilled in the art that various changes and modifications may be made without departing from the scope of the invention as defined in the following claims.

What is claimed is:

1. A microwave oven incorporating therein a cooking chamber, a waveguide, and an apparatus for generating a microwave, said apparatus being further characterized in that said apparatus comprises:

a heating element;

a cathode, mounted above the heating element, for emitting electrons;

a first grid, provided above the cathode, for controlling and focusing the flow of electrons emitted from the cathode, the first grid having a plurality of holes for converting electrons from the cathode to the electron beams;

a choke structure for serving as a blocking capacitor, the choke structure being positioned between the cathode and the first grid, wherein the cathode, the first grid and the choke structure define an input cavity functioning as a resonant circuit;

means for making a variable resistance value, one end of which is connected to the first grid and the other end thereof is connected to the cathode, for inducing a bias voltage on the first grid;

a controller for controlling the means for making a variable resistance value to thereby generate a plurality of resistance values;

a second grid provided above the first grid and having a plurality of holes through which the electron beams passing through the holes of the first grid pass;

an anode for receiving the electrons passing through the holes of the second grid, wherein the second grid and the anode define an output cavity for generating a microwave, the output cavity being electrically insulated from the input cavity;

cooling fins, provided around the anode, for cooling heat generated by the anode;

a driving voltage source for providing a driving voltage to the cathode and the anode;

an antenna arranged in the anode, for extracting the microwave from the output cavity into the cooling chamber through the waveguide; and a feedback structure extending from the input cavity to the output cavity, for feeding a portion of the microwave in the output cavity back to the input cavity.

2. The microwave oven of claim 1, wherein the means for making a variable resistance value is an array of resistors.

3. The microwave oven of claim 1, wherein the means for making a variable resistance value is a trimming resistor.

4. The microwave oven of claim 1, wherein the apparatus maintains a vacuum state therein.

5. The microwave oven of claim 1, wherein the second grid is distanced apart from the first grid in such a way that the electron beams passing through the holes of the first grid generate a microwave in the output cavity before they become diffused.

6. The microwave oven of claim 1, wherein the first grid initially has a zero bias voltage.

7. The microwave oven of claim 1, wherein the feedback structure has a rod shape.

8. The microwave oven of claim 1, wherein the antenna is, at its one end, provided with a loop-shaped coupling, the coupling being disposed in the output cavity, for extracting microwaves therefrom.

* * * * *